United States Patent [19]

Rohrbach et al.

[11] Patent Number: 4,691,641

[45] Date of Patent: Sep. 8, 1987

[54] VEHICLE ACCUMULATION SYSTEM

[75] Inventors: Peter Rohrbach, Bath; William Benzak, Bethlehem, both of Pa.

[73] Assignee: SI Handling Systems, Inc., Easton, Pa.

[21] Appl. No.: 831,767

[22] Filed: Feb. 21, 1986

[51] Int. Cl.[4] ..... B61B 13/12

[52] U.S. Cl. ..... 104/166; 104/165

[58] Field of Search ..... 104/166, 172 S, 172 BT, 104/165; 74/89

[56] References Cited

U.S. PATENT DOCUMENTS

| | | | |
|---|---|---|---|
| 3,356,040 | 12/1967 | Fonden | 104/130 |
| 3,818,837 | 6/1974 | Jacoby et al. | 104/166 |
| 3,842,752 | 10/1974 | Harwich | 104/166 |
| 4,036,148 | 7/1977 | Jones et al. | 104/166 |
| 4,065,007 | 12/1977 | Kurahashi | 104/166 X |
| 4,132,174 | 1/1979 | Ziegenfuss et al. | 104/48 |
| 4,353,306 | 10/1982 | Rohrbach et al. | 104/166 |
| 4,355,580 | 10/1982 | Scheel | 104/166 |
| 4,363,275 | 12/1982 | Kaji | 104/166 |
| 4,367,683 | 1/1983 | Tokunaga | 104/166 |
| 4,593,623 | 6/1986 | Gutekunst et al. | 104/166 |

*Primary Examiner*—Robert B. Reeves
*Assistant Examiner*—Russell D. Stormer
*Attorney, Agent, or Firm*—Seidel, Gonda, Goldhammer & Abbott

[57] ABSTRACT

An accumulation system for driverless vehicles of the type which are propelled along a track by contact between the drive wheel and a rotating drive shaft. Accumulation being caused by contact between a swing arm extended from the front end of a driverless vehicle. The swing arm pivots towards the front end of the driverless vehicle causing a corresponding rotation of the drive wheel with respect to the rotating drive shaft. The change in position of the drive wheels with respect to the axis of the drive shaft causes a deceleration of the driverless vehicle and/or accumulation of the vehicle with respect to the adjacent driverless vehicle on the track.

9 Claims, 2 Drawing Figures

VEHICLE ACCUMULATION SYSTEM

BACKGROUND OF THE INVENTION

This invention relates to an accumulation system for driverless vehicles of the type which are propelled along a track by frictional contact between a drive wheel and a rotating drive shaft. In particular, this invention relates to the deceleration and accumulation of a number of driverless vehicles along a track without the need for direct cooperation between one vehicle and a fixed cam on the rear end of an adjacent vehicle. This invention may also be utilized to cause the vehicle to reverse its direction of motion along the track.

An accumulation system for driverless vehicles is shown in U.S. Pat. No. 3,818,837 and includes a speed control device or tail which is attached to the rear end of the vehicle for cooperation with a drive control member on the front end of the next adjacent vehicle. The speed control device is typically in the form of a cam. The contact between the tail on one vehicle and the drive control member on an adjacent vehicle on the track causes the trailing vehicle to accumulate or stop adjacent to the forward vehicle. Release of the forward vehicle will also cause a corresponding release of the trailing vehicle. The cam on the tail is contoured such that the change in speed of the trailing vehicle is effectuated gradually.

SUMMARY OF THE INVENTION

The invention generally comprises a swing arm or bell crank which pivots on and extends away from the front end of a typical driverless vehicle. A connecting rod is pivotably attached at one end to the swing arm and at the other end to an actuator rod positioned on the under side of the driverless vehicle. The actuator rod is connected to a drive wheel support on the vehicle such that motion of the actuator rod causes a rotation of the drive wheel(s) and their corresponding support(s) about a central vehicle axis.

Contact by the swing arm with an adjacent vehicle causes a rotation of the swing arm about its pivot. The end of the swing arm makes an arc towards the front of the driverless vehicle. The movement of the swing arm by means of the connecting rod and the actuator rod causes a change in the angle of contact between the drive wheel and the rotating drive shaft. Accumulation occurs when the swing arm reaches a position substantially adjacent to the front end of the driverless vehicle. The drive wheel in this accumulation position is at an angle of approximately 90° with respect to the axis line of the rotating drive shaft. During the arc of the swing arm the driverless vehicle is steadily decelerated prior to being completely stopped. The swing arm can also be utilized to reverse the movement of the vehicle by causing a rotation of the drive wheel past the 90° position.

The pivoting motion of the swing arm of the invention can cause accumulation to occcur by contact with any adjacent surface along the track and, therefore, does not require a second vehicle for accumulation to occur. Additionally, the swing arm can be controlled to decelerate the driverless vehicle to a reduced operational speed. Thus, adjacent driverless vehicles may be accumulated by simultaneously reducing their operational speed along one portion of the track.

By providing an accumulation system which requires only contact of a swing arm with an adjacent driverless vehicle and not the alignment and engagement of a drive control member with cam on a tail, the system may operate on inclined or curved track portions. The overall length of a vehicle is reduced by the elimination of the a speed control tail on each vehicle in the system. This reduction in length plays an important role in the movement of vehicle on transport mechanisms, such as elevators and turntables, in the track system. Additionally, the swing arm may be utilized to reverse the direction of the vehicle by causing a rotation of the drive wheel, with respect to the drive shaft, past the 90° or accumulation postion.

Further advantages will become apparent by particularly describing the preferred embodiment of the invention.

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
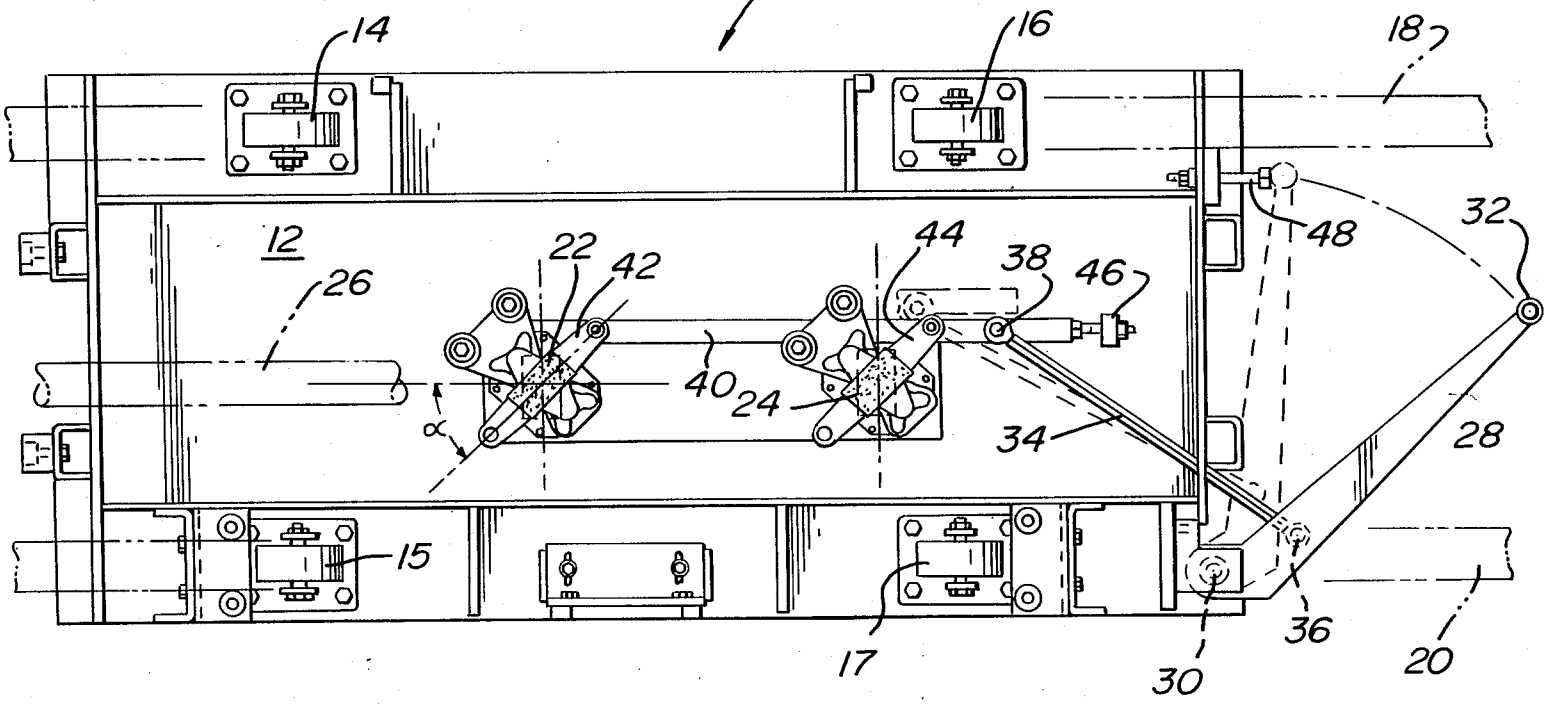
FIG. 1 shows a bottom view of a driverless vehicle which incorporates the invention.
Figure 2:
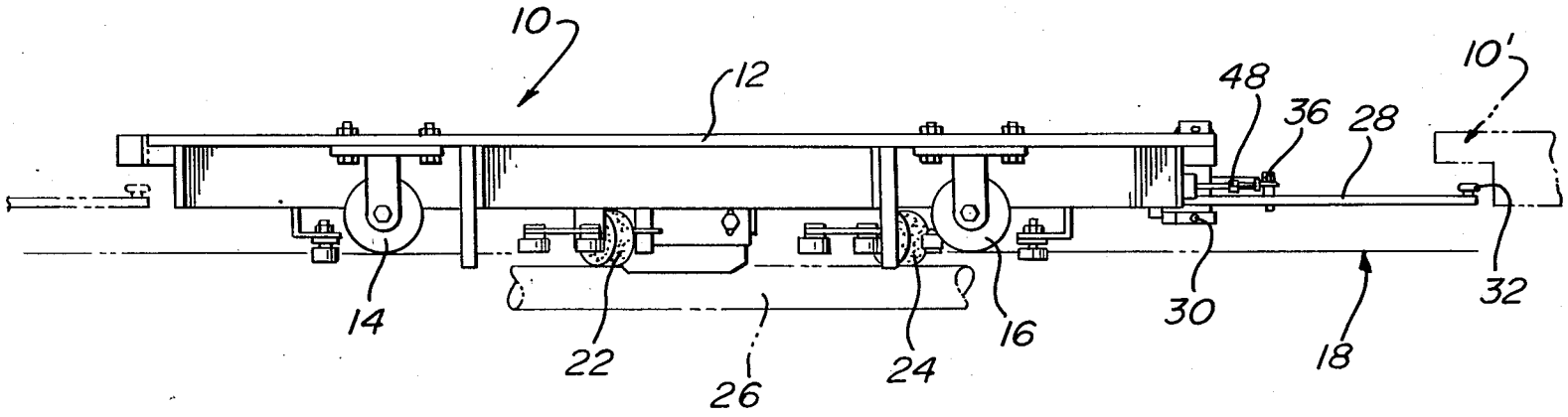
FIG. 2 shows a sectional view of FIG. 1 with the driverless vehicle in the accumulation position.

In FIG. 1 the underside of a typical driverless vehicle 10 is shown having a platform 12 and support wheels 14–17. The support wheels 14–17 ride along the rails 18 and 20 of a track. The vehicle 10 is propelled by contact between drive wheels 22 and 24, supported on the underside of the platform 12, and a rotating drive shaft 26, positioned between the track rails 18, 20.

A swing arm 28 is pivoted on and extends away from one end of the driverless vehicle 10. Swing arm 28 is in the form of a bell crank and is secured at one corner of the platform 12 at pivot 30. The opposite end of the swing arm 28 from pivot 30 supports a guide roller 32 which is positioned for contact with the rear surface of an adjacently positioned second driverless vehicle 10' on the tracks. Contact between the roller 32 and the adjacent vehicle 10' causes the swing arm 28 to rotate or arc about pivot 30 towards the front end of driverless vehicle 10.

A connecting rod 34 is attached to swing arm 28 at bearing 36. The location of the bearing 36 on the swing arm 28 may be at any convenient position between pivot 30 and guide roller 32. However, there is a mechanical and operational advantage created by positioning the bearing at specific locations between pivot 30 and guide roller 32. The ratio of the distances from pivot 30 to bearing 36 and bearing 36 to roller 32 may be varied such that a minimal pressure is required to close the swing arm 28 towards the vehicle body. Also, this ratio may be utilized to shorten the arc of the swing arm and to vary the effective decelaration rate of the vehicle. The opposite end of connecting rod 34 is attached to an actuator rod 40 at a second bearing 38. Actuator rod 40 is attached to drive wheel supports 42 and 44 which correspond to drive wheels 22 and 24, respectively.

Drive wheel supports 42 and 44 are attached to the underside of platform 12 and are rotatable about a central vertical axis. The drive wheels 22, 24 are positioned to frictionally contact the rotating drive shaft 26. Rotation of the supports 42, 44 causes change in the angle (alpha) of contact of the drive wheels 22, 24 with the rotating drive shaft such that speed of the driverless vehicle varies. A vehicle will stop when the alpha angle is approximately 90° with respect to the axis line of the drive shaft. (As shown by the broken lines in FIG. 1). Maximum speed of the driverless vehicle 10 is maintained by an alpha angle of approximately 45° with respect to the axis line of the rotating drive shaft (FIG. 1). The speed of the driverless vehicle can be varied from this maximum by increasing angle alpha with respect to the rotating drive shaft 26 to a minimum speed positon of 90° or the accumulation position. The relative position of the drive wheel 22, 24 may also be varied to reverse the direction of movement of vehicle along the track. This reverse in direction is effected by an arc of the swing arm which causes a rotation of the drive wheels 22, 24 past the 90° position. This motion will act to relieve the pressure of a series of accumulated vehicles on the first or lead vehicle in a chain and may also be used to assist in decelerating a vehicle traveling at a high rate of speed or carrying a heavy load.

The driverless vehicle 10 is propelled along the track to a position adjacent to a the second driverless vehicle 10'. The guide roller 32 of swing arm 28 contacts the adjacent driverless vehicle 10' and causes the swing arm 28 to rotate about pivot 30. It should be noted that the first driverless vehicle 10 may be placed in the accumulated condition by any blocking support other than the adjacent vehicle 10'. As the swing arm 28 pivots, connecting rod 34 moves actuator rod 40 causing the drive wheel supports 42, 44 to pivot about their central vertical axis. The pivot of the supports 42, 44 causes a corresponding rotation of the drive wheels 22, 24. As the guide roller 32 approaches the accumulation position adjacent to the front of the vehicle 10, the vehicle 10 will decelerate due to the steady increase in the alpha angle between the drive wheels 22, 24 and the rotating drive shaft 26.

Once the adjacent driverless vehicle 10' or blocking support is removed, an opening motion of the swing arm 28 towards the extended position is caused by a spring bias of the supports 42, 44. The opening motion of the swing arm 28 causes an accelleration of the driverless vehicle 10 due to the decrease in the alpha angle between the drive wheel and the rotating drive shaft. The maximum extension of the swing arm condition of the driverless vehicle 10 is fixed by stop 46 which contacts one end of the actuator rod 40 during the opening motion of the swing arm due to the return of the spring bias. Stop 46 may be adjusted to limit the opening motion such that the drive wheels 22, 24 may be maintained at any desired maximum speed.

A second stop 48 extending from the front end of the driverless vehicle 10 may also be provided to limit the pivoting or arc motion of the swing arm 28 towards its accumulation position. The position of the second stop 48 is variable, such that the vehicle 10 may be placed in a decelerated condition with a continuous operating speed which is less than its maximum (45° position) but greater than the accumulation position (90° position). This second stop 48 may also be utilized to place the drive wheels 22, 24 in the reverse position which is beyond the accumulation position (90°) to reverse the direction of movement of the vehicle caused by contact between the drive wheels and the drive shaft.

The accumulation system of the invention will slow and stop a vehicle by contact against any square object in its path, thereby acting to accumulate vehicles at any point along the track. Additionally, the swing arm can be used to accumulate driverless vehicles around radius turns in the track or accumulate a number of vehicles at a reduced speed along the track. The swing arm 28 when approaching a turn table or other type vehicle transfer mechanism may be placed in the accumulated position such that the overall length of the car will be substantially that of the platform 12 of the driverless vehicle 10. The swing arm 28 may also be retracted to place the drive wheels 22, 24 in the reverse motion position so as to relieve pressure on the lead vehicle in a line of accumulated vehicles or to back the vehicle away from a fixed location to space adjacent vehicles from one another during accumulation or during simultaneous reduction of speed. All of these features are an improvement over the known driverless vehicles having cam tails or other projections which extend beyond the end of the driverless vehicle.

The present invention may be embodied in other specific forms without departing from the spirit or essential attributes thereof and, accordingly, reference should be made to the appended claims, rather than to the foregoing specification, as indicating the scope of the invention.

We claim:

1. A driverless vehicle having a pivotable drive wheel spring-biased to a predetermined position relative to a rotating drive shaft comprising: accumulation means having a swing arm mounted on said vehicle so as to pivot about a fixed pivot axis on said vehicle such that the swing arm travels over an arc between an extended position and a closed position, a drive actuator connected to said drive wheel and adapted upon movement thereof to pivot said drive wheel relative to said drive shaft so as to vary the speed of the vehicle, a rod pivotably interconnecting said actuator and said swing arm such that said swing arm is spring-biased to said extended position by said spring-biased drive wheel whereby contact between said swing arm and a surface on an adjacent driverless vehicle causes said swing arm to travel over said arc from said extended position to said closed position and said rod causes said actuator to rotate said drive wheel relative to said drive shaft so as to decelerate and accumulate the driverless vehicle with respect to said adjacent driverless vehicle.

2. A driverless vehicle as claimed in claim 1 wherein the adjustable stop is positioned on the front end of the vehicle such that the pivoting motion of the swing arm causes a reverse propulsion of the vehicle when the swing arm contacts the adjustable stop.

3. A driverless vehicle as claimed in claim 1 further comprising an actuator stop contacting with said drive actuator during the return motion of the drive actuator and limiting the extension of said swing arm so as to fix the maximum speed of the driverless vehicle and the angle of contact between the drive wheel and the drive shaft at a predefined relationship.

4. A driverless vehicle having a pivotable drive wheel spring-biased into driving relation with a rotating drive shaft comprising: a swing arm mounted on said vehicle so as to pivot about a fixed pivot axis on said vehicle such that the swing arm travels over an arc between an extended position and a closed position; actuator means for varying the angle of the drive wheel with respect to the drive shaft by pivoting the drive wheel so as to vary the speed of the vehicle; means connecting said swing arm and said actuator means such that pivoting motion of said swing arm from said extended position to said closed position causes a corresponding pivoting motion of the drive wheel so as to substantially reduce the speed of the vehicle; and means for adjusting the travel of the swing arm by varying the location of said closed position such that said corresponding pivoting motion of said drive wheel changes said angle as said swing arm travels over said arc to said closed position so as to decelerate the driverless vehicle in one direction to an accumulated position and maintain the vehicle in said accumulated position by urging the vehicle in a reverse direction.

5. A driverless vehicle as claimed in claim 4 wherein said connecting means comprises means comprises a rod attached at one end to said swing arm and at its opposite end to said actuator means.

6. A driverless vehicle as claimed in claim 5 wherein said attachment of said rod to said swing arm is made closely adjacent the pivot point of said swing arm.

7. A driverless vehicle as claimed in claim 5 wherein the attachement of the rod to the swing arm is variable along the length of the swing arm.

8. A driverless vehicle of the type propelled along a track by contact between a drive wheel and a rotating drive shaft, the vehicle comprising:

a body;

support wheels adapted to ride on the track, said support wheels being mounted on and supporting the body;

a swing arm pivotably attached to one end of the body for pivoting about a fixed pivot axis on said body, said swing arm forming a bell crank and mounted for extension away from the body end;

means for rotatably supporting the drive wheel on said body for movement of said wheel about a vehicle axis;

means for connecting the swing arm and the drive wheel support means, said connecting means adapted to rotate the support means about its vertical axis in response to a corresponding pivoting motion of the swing arm;

means for biasing the swing arm to extend away from the body end;

means to limit the extension of the swing arm, said extension limiting means adapted to position the drive wheel in a vehicle maximum speed condition with respect to the drive shaft upon full extension of the swing arm;

means to limit the pivoting motion of the swing arm towards the body, said pivot limiting means adapted for selective adjustment such that the drive wheel may cause either decelaration of the vehicle with respect to its full extension position, accumulation of the vehicle along the track, or reverse movement of the vehicle with respect to the full extension position.

9. A driverless vehicle as claimed in claim 8 further comprising: means to contact an adjacent driverless vehicle on the track, said contact means mounted on the swing arm and adapted to cause the pivoting motion of the swing arm towards the body of the vehicle and the corresponding motion of the drive wheel support means upon contact.

* * * * *